United States Patent [19]

Rowledge

[11] Patent Number: 4,479,613

[45] Date of Patent: Oct. 30, 1984

[54] PULVERIZING MACHINES

[75] Inventor: Bernard J. Rowledge, West Midlands, England

[73] Assignee: Sardon International Limited, England

[21] Appl. No.: 318,291

[22] Filed: Nov. 4, 1981

[30] Foreign Application Priority Data

Nov. 1, 1980 [GB] United Kingdom ..... 8035214

[51] Int. Cl.[3] ..... B02C 23/32; B02C 23/34

[52] U.S. Cl. ..... 241/48; 241/52; 241/80; 241/97; 241/188 R; 241/189 R

[58] Field of Search ..... 241/79, 80, 97, 154, 241/52, 188 R, 48, 189 R

[56] References Cited

U.S. PATENT DOCUMENTS 3,490,704 1/1970 Bourne et al. ..... 241/154

3,917,175 11/1975 Maeda et al. ..... 241/80

FOREIGN PATENT DOCUMENTS 857861 12/1970 Canada ..... 241/79

*Primary Examiner*—Mark Rosenbaum

*Assistant Examiner*—Timothy V. Eley

*Attorney, Agent, or Firm*—Neil F. Markva

[57] ABSTRACT

A pulverizing machine in which alongside the pulverizer rotor 16 are a classifier zone 29 and a conveyor zone 41. The rotor 16 has pulverizer members 25 which project into an annular reducing zone 27. Guide means 17 is provided in the conveyor zone to provide spiral paths to convey a rotating flow of air and reduced material spirally inwards from one end part 45 of the reducing zone to the classifier zone 29, and the latter is positioned to allow oversize material particles to pass outwards from the classifier zone directly to said end part of the reducing zone while the undersize particles are carried inwards, optionally via a rotary classifier 18, to an outlet 15.

9 Claims, 8 Drawing Figures

PULVERIZING MACHINES

BACKGROUND OF THE INVENTION

In known pulverizing machines the classifier means comprises a rotary classifier, and the machines are arranged so that a flow of air and particulate material is conveyed from the reducing zone to the rotary classifier, from which rotary classifier oversize particles of the material are returned to the rotor for further reduction.

In some of these pulverizing machines, for example the machines described in British patent specification No: 1333044, the pulverizer rotor and the housing provide spaced apart surfaces between which surfaces the air and particulate material flow passes in a direction towards the classifier and the oversize particles pass through this flow against the direction of flow, which gives rise to certain disadvantages where considerable quantities of oversize particles are being returned due to the latter impeding the flow. For example, the machines need a very considerable air supply to maintain the flow, and have a consequential high power consumption.

These disadvantages are reduced in other known forms of the pulverizing machines, which machines are arranged to provide a return path for the oversize particles to return to the rotor without passing completely through said flow to the classifier. However, the known return paths return the oversize particles to mix with the un-reduced material fed to the rotor by a feed means so that the returned oversize particles undergo the substantially same reduction processes as the un-reduced material, for example, as indicated in FIGS. 8–50 of the "Chemical Engineers Handbook" published in 1973 in the U.S.A. by McGraw-Hill Inc. Such pulverizing machines thus produce large amounts of particles which are reduced to a much smaller size than the maximum size acceptable, i.e. excessive reduction arises, with a consequential heavy power consumption.

In other known forms, for example, the Mikro-ACM Pulverizer shown in FIGS. 8–51 of the "Chemical Engineers Handbook" published in 1973 in the U.S.A. by McGraw-Hill Inc., a shroud is provided between part of the flow path to the rotary classifier and the return path. However, baffles are required to enable the air flow to move the particulate material inwardly toward the axis of the rotary classifier, for classification. Baffles are located in said part of the flow path to ensure that the flow has little or no rotational momentum. Consequently, substantially the whole of the material in the flow must enter and be accelerated rotationally by the classifier and the oversize particles ejected from the classifier against the flow direction, if the passage of unclassified material to the return path is to be prevented. This arrangement gives rise to other disadvantages. For example it imposes considerable demands on the design, operation and power supplies of the classifier, with a consequential heavy power consumption.

An object of the invention is to enable the power consumption to be reduced or utilized more efficiently while enabling the aforementioned disadvantages to be avoided or reduced.

SUMMARY OF THE INVENTION

According to the present invention there is provided a pulverizing machine which is characterized in that:

(a) the classifier means comprises a classifier zone alongside the pulverizer rotor;

(b) a conveyor zone of annular form is provided in said chamber, which conveyor zone has an outer portion alongside one end of the reducing zone and an inner end portion alongside the classifier zone;

(c) at least one of said pulverizer members has an extension which extends in said reducing zone across the periphery of the classifier zone to adjacent said conveyor zone; and (d) the machine is provided with guide means which includes guide members extending within the conveyor zone to define therein a plurality of part spiral conveyor paths to convey a flow spirally inwards from said outer part to said inner part.

In use, air is supplied so as to flow through the apparatus from the inlet to the outlet. Material, fed into the chamber, is reduced in the reducing zone by the pulverizer rotor and mixes with the air flowing in the chamber. The rotor imparts a rotational velocity to the flow of air and material in the reducing zone, and causes the rotating flow to move, in a first direction parallel to the of the apparatus, across the reducing zone to the outer part of the conveyor zone. In the conveyor zone the flow enters the conveyor paths to move inwards to the inner part, and therafter moves from the inner part to the classifier zone, while maintaining a large proportion of the kinetic energy of the flow.

The maintaining of the kinetic energy permits much of the rotational momentum of the material to be conserved, so that centrifugal forces tend to cause the material to move outwards along a return path from the classifier zone directly to the reducing zone so as to pass said extension or extensions. The reduced material can thus be subjected to a substantial degree of classification in the absence of any rotary classifier.

Furthermore, a partition is preferably provided between said extensions and the guide means so that the return path is quite separate from the conveyor paths due to the partition therebetween, thus avoiding the known problems caused by particles of material or flows moving in opposite directions. The return path leads to a final portion of the reducing zone immediately adjacent the conveyor zone so that the returned particles only undergo a much shorter period of further reduction, and thus the problems caused by interference of the returned particles with the initial reduction of the material are reduced and the production of undersized particles is minimized. The invention provides further advantages. For example, the passage of the flow of air and material through the plurality of conveyor paths causes a slowing of the faster moving particles due to collisions with the slower moving particles, and causes the speed of the latter to be increased, thus making the particle velocities more uniform and improving the effectiveness of the classification.

The guide members may be part spiral or part chordal form, and may be movable or adjustable to vary the effect of the guide means upon said flow, e.g. to modify the classification.

The classifier means preferably further includes a rotary classifier which is rotatable within the classifier zone to provide further or improved classification. The rotary classifier may have variable speed drive means or connected by variable speed transmission means to means for driving the pulverizer rotor and may be confined to an inner portion of the classifier zone or may extend into or across the part of the classifier zone alongside the inner part of the conveyor zone.

The extensions serve also as impeller members which tend to create or drive a flow of air along the return path, and the machine may incorporate rotary attenuator means to reduce this impeller effect. The attentuator means may be incorporated into the rotary classifier or may be substituted in place of the rotary classifier. The attenuator means may likewise have a variable speed drive means or variable speed transmission means connected to means for driving the pulverizer rotor.

The means to admit material to the chamber preferably comprises an opening at the periphery of a main portion of the reducing zone which main portion is disposed alongside the final portion. The air inlet may be arranged so as to be tangential to the rotor and immediately before (in the direction of rotor rotation) of the opening. This arrangement of the air inlet and opening causes the air flow to apply a thrust to the material in the direction of rotation. A further or alternative air inlet may be provided to supply an air flow in a direction towards the side of the rotor remote from the conveyor zone to apply a thrust in said first direction parallel to said axis.

The pulverizer rotor and the rotary classifier are preferably operatively connected to the same drive motor.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
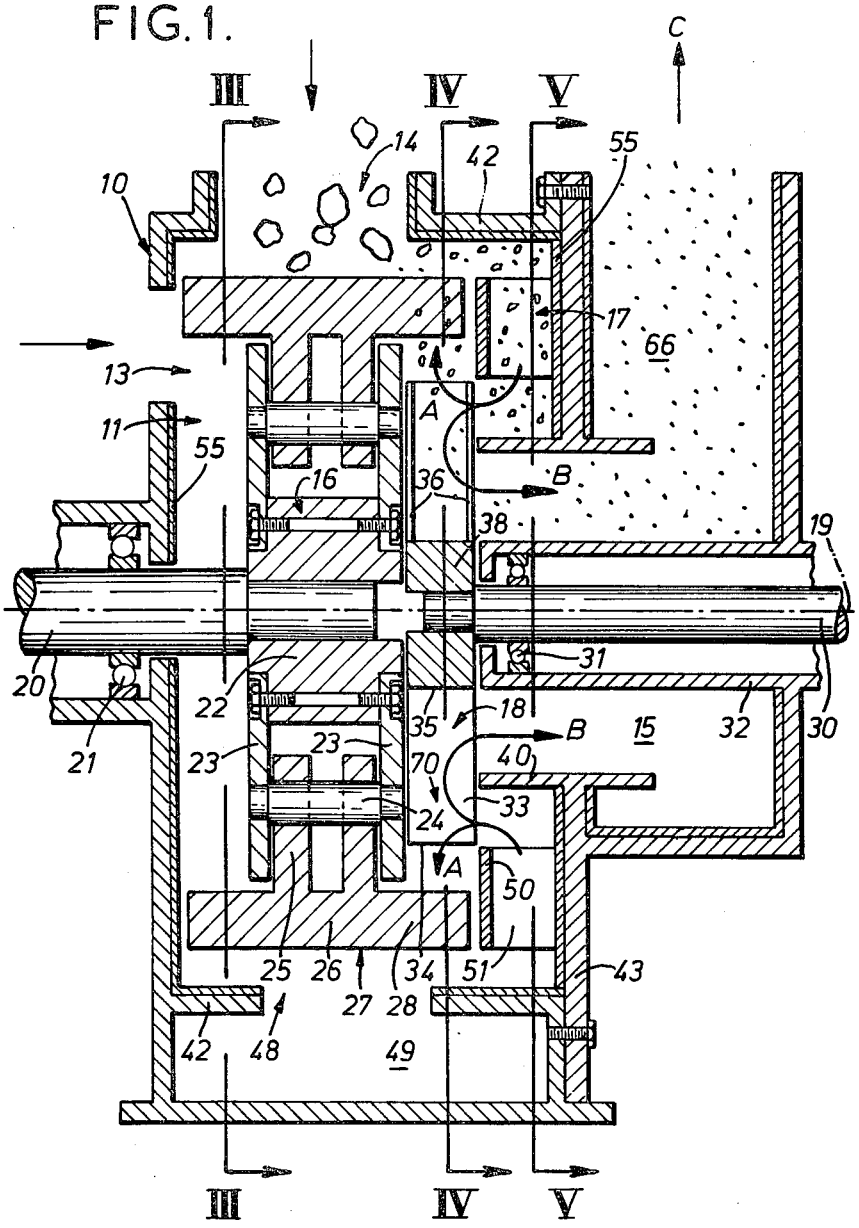
FIG. 1 shows a vertical section, of a grinding machine of the invention, in a plane including the axis of a pulverizer rotor of the machine.

Both forms of the pulverizing machine comprises a housing 10 which defines a chamber 11, and includes a main air inlet 12, a secondary air inlet 13, a material inlet 14 and an outlet 15. Within the chamber 11 are a pulverizer rotor 16, guide means 17 and a rotary classifier 18. The chamber 11 is substantially cylindrical about an axis 19 of a rotor drive shaft 20 which is mounted on bearings 21 so as to project into the chamber 11 through one side wall of housing 10.

The pulverizer rotor 16 comprises a hub 22 carrying a pair of parallel circular side plates 23 which support a circular array of bearing pins 24. Each pin 24 carries a swingable pulverizer member 25 having an outer section 26 which projects radially from the periphery of rotor 16 so as to be disposed in an annular reducing zone 27 of chamber 11. Zone 27 is indicated in broken lines in FIG. 2.

Each outer section 26 has an extension 28 which projects from one side of the rotor 16, in a direction parallel to axis 19, across the periphery of a classifier zone 29 of chamber 11. Zone 29 is approximately cylindrical as indicated in broken lines in FIG. 2.

The rotary classifier 18 is disposed within the classifier zone 29 (indicated in broken lines in FIG. 2), so as to be closely adjacent said one side of the rotor 16, and is carried by a second shaft 30, co-axial with axis 19. Shaft 30 is carried by bearings 31 carried by a support 32 which projects within the outlet 15 to adjacent the rotary classifier 18.

The housing 10 includes an annular wall 40 co-axial with the axis, which wall 40 that is surrounds the outlet and extends into the chamber to terminate at one side of the classifier zone 29. The wall 40 also serves an inner boundary of an annular conveyor zone 41 indicated in broken lines in FIG. 2, which zone 41 extends outwards to a peripheral wall 42 of the housing so as to be disposed between a second side wall 43 of housing 10 and adjacent portions of the reducing and classifier zones. These adjacent portions comprise an outer portion 44 (FIG. 2) of the classifier zone 29 and a final portion 45 (FIG. 2) of the reducing zone 27.

The guide means 17 comprises a ring member 50 which is disc shaped, and several guide members 51, and is disposed across an intermediate portion of the conveyor zone 41, which intermediate portion is disposed between an inner portion 52 (FIG. 2) and an outer portion 53 (FIG. 2) of the conveyor zone 41.

Figure 5:
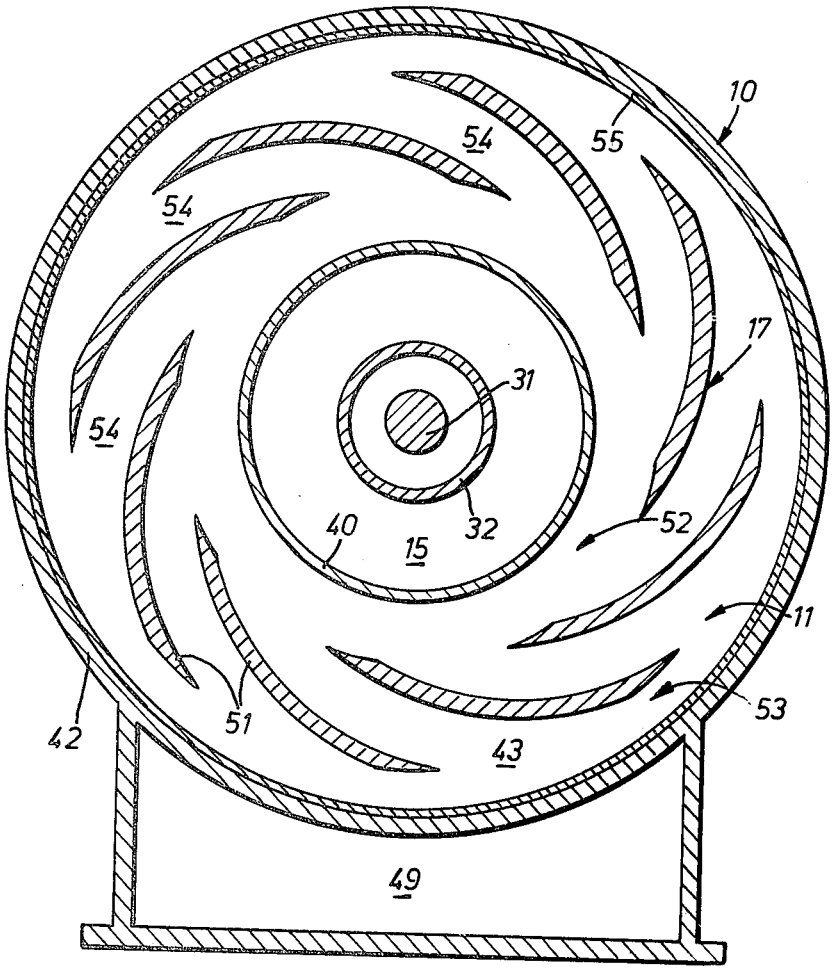
Figure 8:
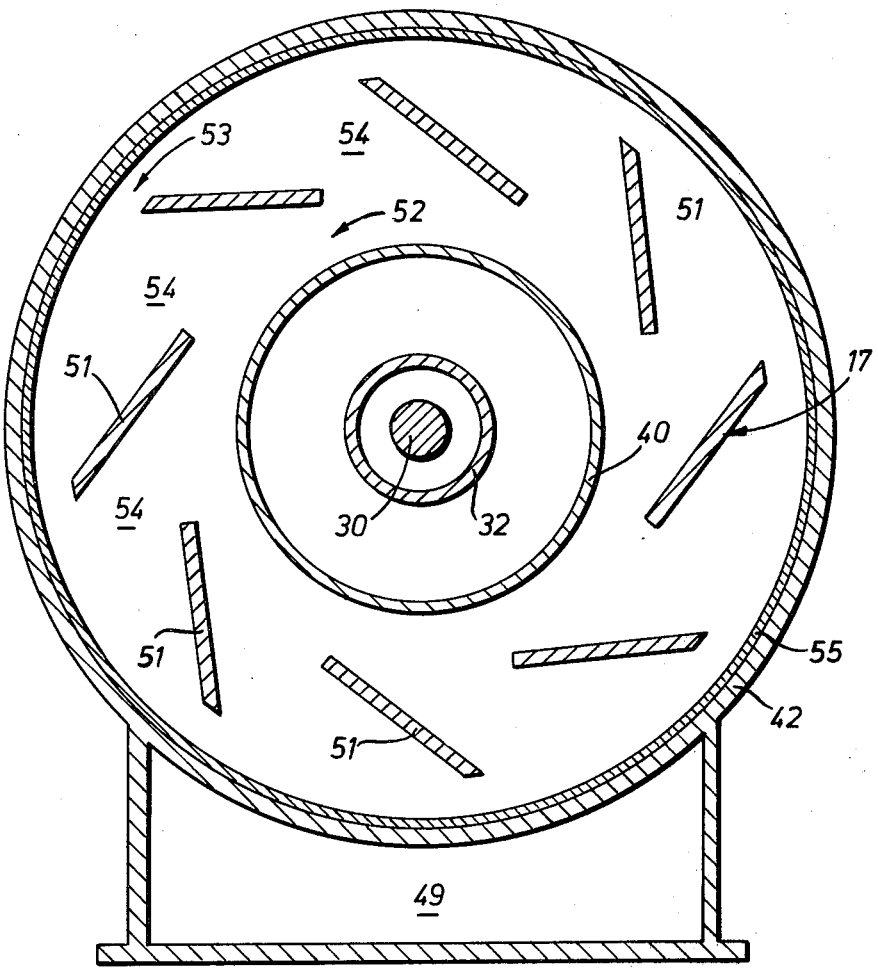

The ring member 50 serves as a partition between the intermediate portion and said adjacent portions 44 and 45. The guide members 51 extend from said partition to the wall 43 and are shaped to define part spiral conveyor paths 54 (FIGS. 5 and 8) which extend from said outer portion 53 to said inner portion 52 of conveyor zone 41.

The extensions 28 lie in and are outwardly surrounded by the final portion 45 of reducing zone 27, which final portion extends from a main portion 46 (FIG. 2) of the reducing zone 27. The remainder of each outer section 26 is disposed in and is outwardly surrounded by the main portion 46 of reducing zone 27.

Figure 3:
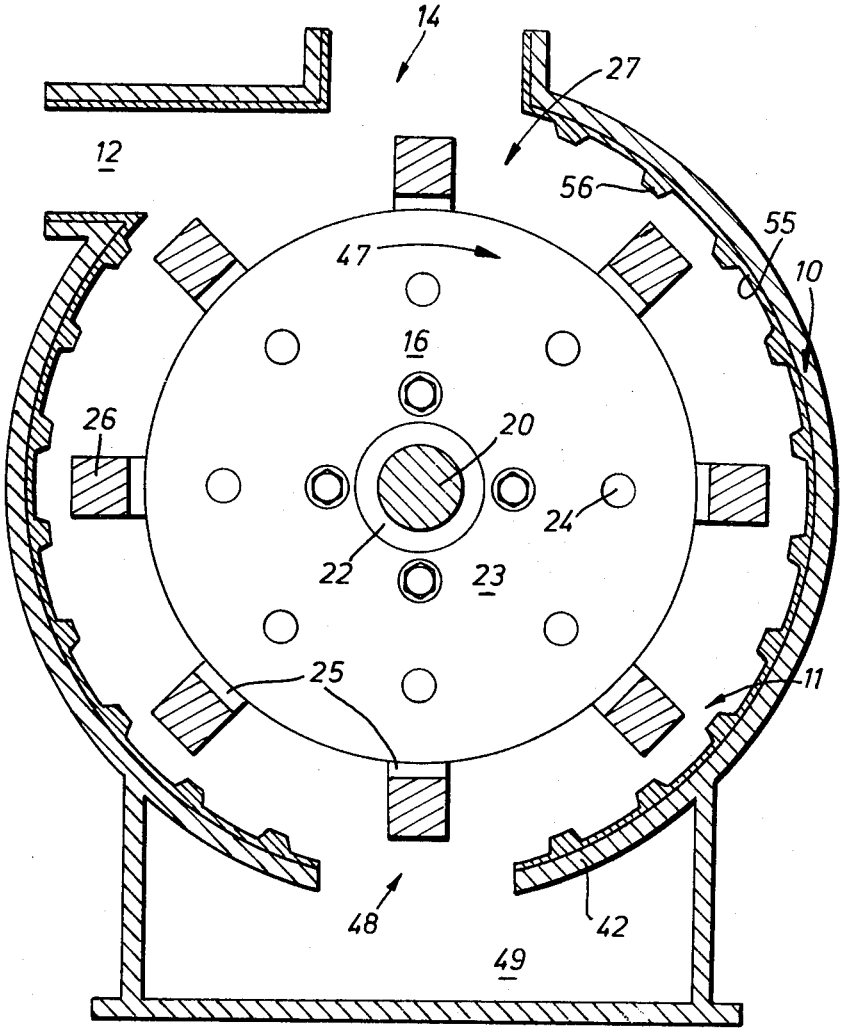
FIGS. 3, 4 and 5 are sections through the machine, normal to said axis, showing, respectively, the pulverizer rotor, a classifier, and guide means of the machine, with some parts omitted for clarity.

The material inlet 14 is disposed at the top of the peripheral wall 42 and is radial to said axis so as to permit material, fed to the inlet by feed means (not shown), to fall towards the rotor 16 through the main portion 46. The main air inlet 12 is disposed adjacent to the material inlet 14, and ahead of the inlet 14 in the direction of rotation (arrow 47 in FIG. 3) of the rotor 16, and is inclined so as to direct the flow of air in a direction tangential to the rotor and directly across the path of the material entering the reducing zone 27. The secondary air inlet 13 is disposed in said one side wall of the housing 10 so as to direct a flow of air through the reducing zone 27 and across the rotor 16 towards the conveyor zone 41. A bottom opening 48 is provided in the peripheral wall 42 to allow foreign bodies to fall into a trap 49 below the chamber 11. The trap 29 has an external door or hatch, not shown.

Thus, relative to the axial direction, there is the main portion 46 of the reducing zone 27; followed by the classifier zone 29 surrounded peripherally by the final portion 45 of the reducing zone 27, which zone 29 and portion 45 are axially offset from the main portion 46; and finally the conveyor zone 41 which is disposed around the outlet 15 and is further axially offset from the main portion 46.

The walls of the chamber 11 have a hard wearing internal skin 55 which is preferably ridged at least around the reducing zone 27 to provide projections 56 transverse to the direction of rotation.

Figure 4:
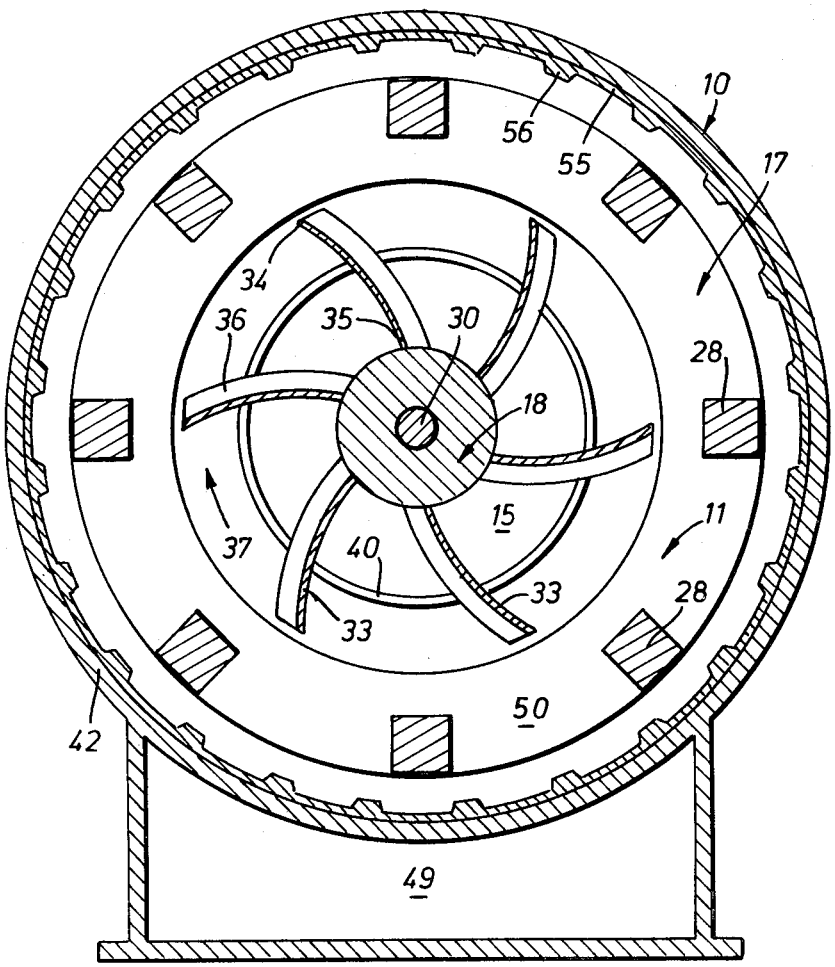

In the form shown in FIG. 1, the rotary classifier 18 comprises several vanes or blades 33, of channel shaped cross-section, which project from a hub 38 on the shaft 30. The vanes or blades 33 are curved to part spiral form so that the outer ends 34 lag the inner ends 35 in the direction of rotation of the classifier, which direction is indicated by the arrow 37 in FIG. 4; and are located so that the walls 36 of the channels project in the direction of rotation.

Figure 6:
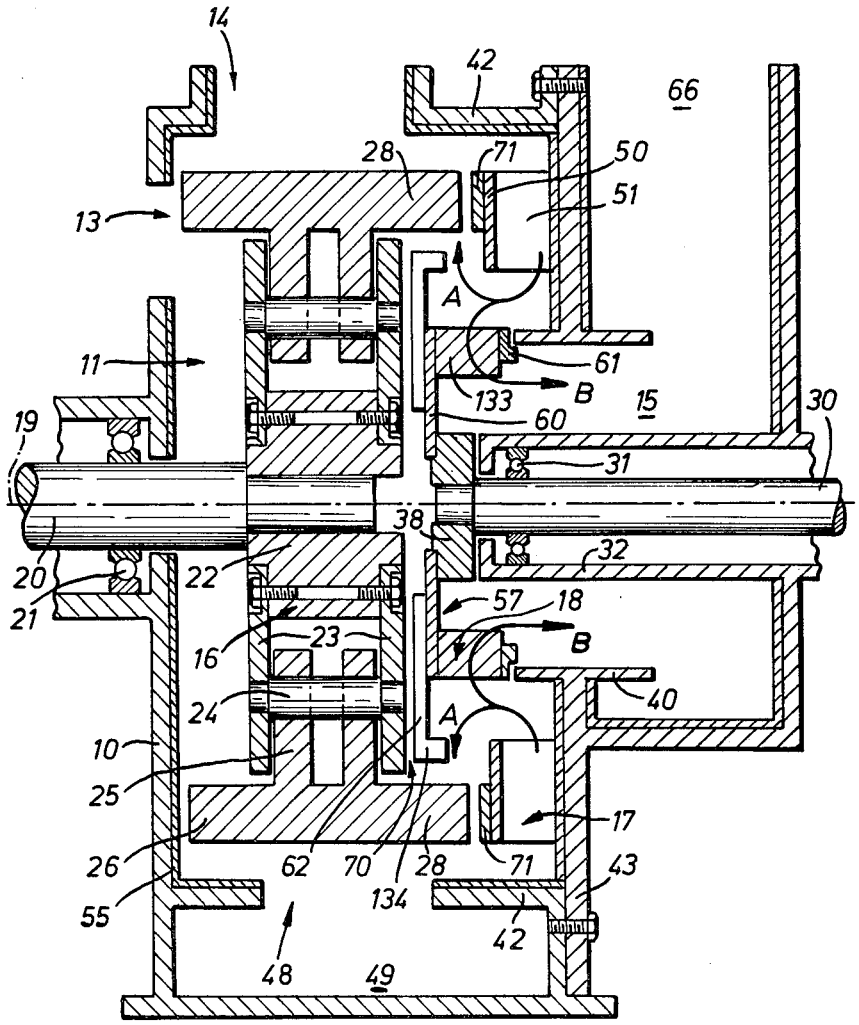
FIGS. 6 shows a modified form of the grinding machine in vertical section.
Figure 7:
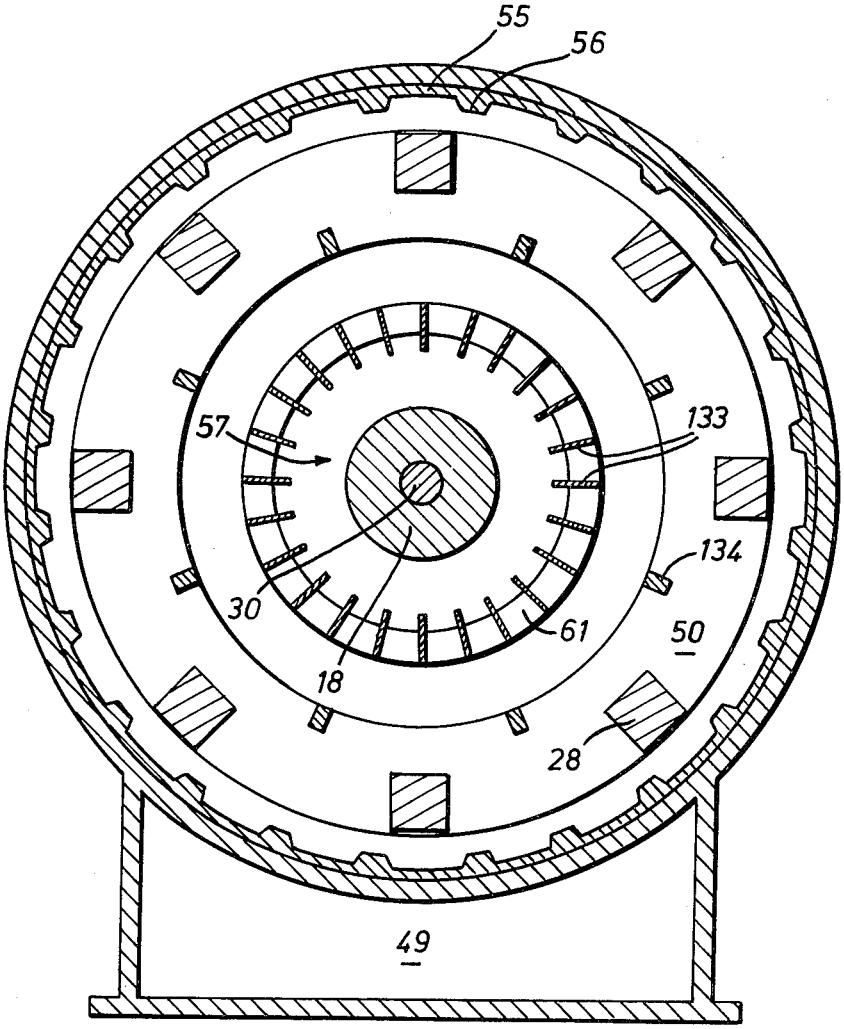
FIGS. 7 and 8 are sections similar to FIGS. 4 and 5, of the modified machine shown in FIG. 6.

In the form shown in FIG. 6, the rotary classifier 18 comprises short radially disposed vanes 133 which are carried by a circular plate 60 secured to the hub 38. These vanes 133 are radially short and terminate at a radius equal to that of the wall 40, and are braced by a ring plate 61 which overlaps the wall 40, which wall 40 is shortened to allow the axial length of the vanes 133 to be increased.

In both forms the rotary classifier 18 incorporates rotary attenuator means 70. In the form shown in FIG. 1 the outer ends 34 of the classifier vanes or blades 33 constitute the attenuator means 70 which is thus integrally incorporated in the rotary classifier: whereas in the form shown in FIG. 6 the circular plate 60 carries radial arms 62 having outer ends 134 which constitute the attenuator means 70.

In use, the material is reduced by the pulverizer members 25 in the main portion 46, and a rotating flow of particulate material and air is produced, which flow moves progressively across the main portion 46 and across the final portion 45 so as to enter the outer portion 44 while still rotating at a considerable velocity. The flow then enters the conveyor paths 54 and is carried by its momentum and the thrust of the air flow spirally inwards to the inner portion of the conveyor zone 41 with minimal energy loss. As mentioned hereinbefore the particle velocities are made more uniform, by mutual collisions, during transit through the paths. The flow then moves, while still rotating, back towards the rotor 16 to enter the outer portion 44 of the classifier zone 29. Irrespective of the presence or absence of, and the diameter and speed of rotation of, the rotary classifier 18, the larger particles of the material will follow a return path indicated by arrow A outwards through the outer portion 44 and back into the final portion 45, due to the centrifugal forces acting on said particles; whereas the smaller particles (having a greater surface area to mass ratio) will be conveyed by the air flow inwards to an inner portion 57 of the classifier zone 29 and then to the outlet 15, along a discharge path indicated by arrow B, so that said classifier zone serves as classifier means which utilizes particle momentum to effect classification.

Figure 2:
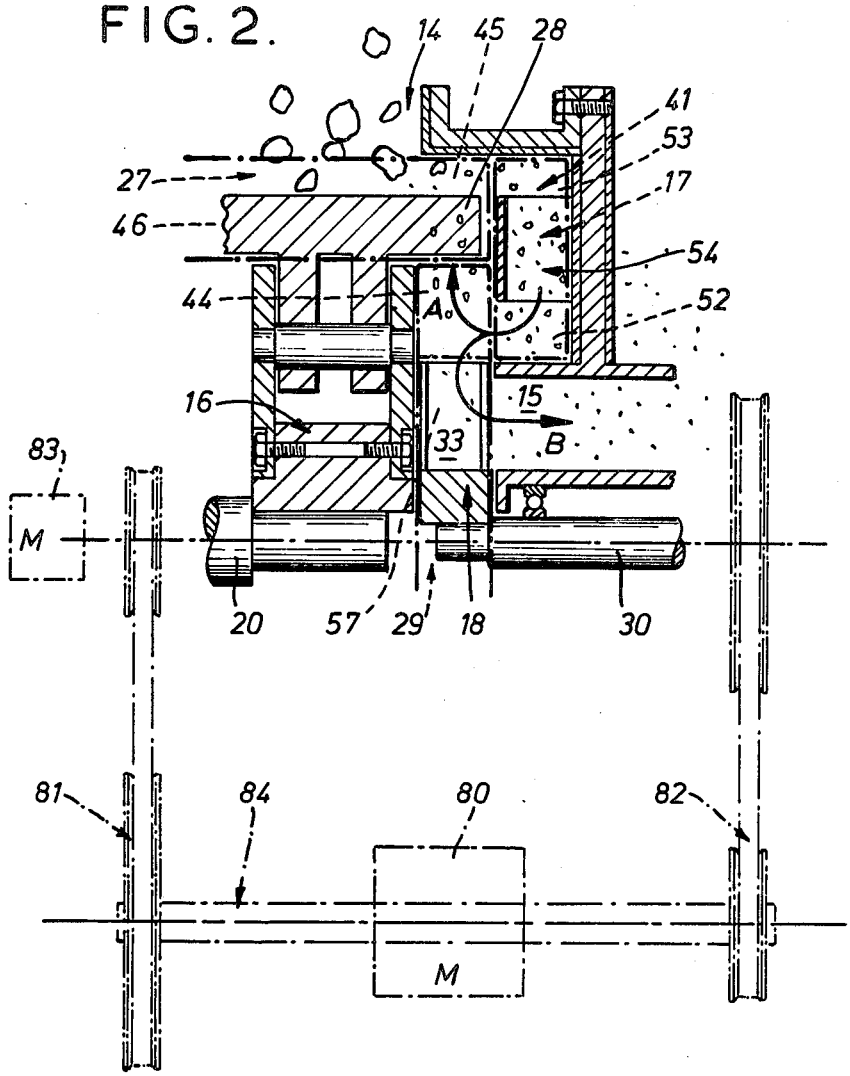
FIG. 2 is a diagram showing parts of zones of a chamber defined within the machine and drive means for the machine.

In the absence of the rotary classifier 18 there will be a substantial amount of particles of intermediate sizes which can follow either of the paths A and B depending on the particle velocities and the position, relative to the axis, of entry into the classifier zone 29. Clearly this amount can be reduced by means of the rotary classifier 18 to reduce the threshold of the size admitted to the outlet 15, which threshold can be varied by varying the speed of rotation or changing the rotary classifier 18 for one of different size or vane structure, e.g. the vanes 33 can project to any degree across the side of the inner portion 52, or may merely project across the side of the outlet 15 as indicated in FIG. 2.

The flow in the machine will create a pressure differential between the portions 53 and 52 tending to cause a flow from the final portion 45 to the portion 44 by-passing the conveyor zone: whereas the extensions 28 act collectively as an impeller to tend to draw a rotating current of air outwards, from the outer portion 44 of the classifier zone 41 to the final portion 45 of the reducing zone 27. In the absence of any attenuator means (e.g. as shown in FIG. 2) the net result will, in most cases, be an appreciable outward movement of the rotating current of air. However, the impeller effect is reduced by the attenuator means 70 if the latter rotates at a lesser speed than the rotational speed of the pulverizer rotor 16. The preferred range of speed of the shaft 30 is between 20% and 50% of the speed of the shaft 20.

The impeller effect upon rotating current can also be reduced by providing radial fins 71 upon the partition as indicated in FIG. 6, and by increasing the spacing between the extensions 28 and the ring partition 50, at the expense of increasing the by-pass effect.

It will be readily appreciated that the foregoing embodiment will provide the advantages, and avoid the disadvantages mentioned hereinbefore, and is adapted to be constructed in an economical manner, e.g. mainly from steel plate, so as to avoid expensive investment in castings and to enable the dimensions of the machines to be selected or varied to suit particular needs without requiring a range of casting patterns. Furthermore, the machine is constructed so as to facilitate repair and modification, e.g. the side 43 (together with the rotary classifier 18, outlet and a discharge duct 66) is detachable from the rest of housing 10 to provide access to the guide means 17, classifier 18 and rotor 16; and the rotor 16 is assembled so that one or both of the side plates 23 can be detached to release the pins 24 and members 25.

Because only part of the reduction of the material fed to the chamber 11 is performed by the extensions 28, and because all the further reduction of the particles, which have returned, via the return path, is performed by the extensions 28, the amount of further reduction can be reduced by reducing the projection of or the number of said extensions 28 without reducing the amount of reduction of the material which takes place in the main portion 46 of the reducing zone 27.

Furthermore, the machine does not "choke" i.e. become blocked, when fractionally overloaded or worked continuously at maximum capacity.

While the pulverizer rotor 16 and the rotary classifier 18 may be connected to separate drive and speed control units, the machine of the invention provides the further advantage that the energy of the flow in the machine is maintained to such a degree that it can drive the rotary classifier 18 and/or the rotary attenuator if the latter is or are arranged to rotate more slowly than the pulverizer rotor 16, and power can be taken off the shaft 30. For example, a drive motor 80 can be connected by a first belt and pulley transmission system 81 to the shaft 20 and by a second belt and pulley transmission system 82, preferably of variable speed form, to the shaft 30 to return power to the shaft 20 via the motor. Alternatively if a drive motor 83 in line with the shaft 20 is used, a lay shaft 84 may connect the transmission systems, as indicated in FIG. 2.

The invention is not confined to the details of the foregoing examples and many variations are possible within the scope of the invention. For example, the guide means may be movable, may comprise adjustable guide members and means to adjust the guide members or means, may have guide members formed from steel plate, and each guide member may be constituted by a plurality of elements, and shaped members may be provided to smooth the path of the flow at the entrance to and the exit from the guide means.

The rotor shaft may also carry the classifier 18 for common rotation. Either or both of the air inlets may be provided. The or some of the pulverizer members 25 may be fixed rigidly to the rotor 16. The size, shape, and form of the ring partition 50 may be varied, e.g. to constrict the return path so that it narrows in the outwards direction, or to broaden the conveyor paths to compensate for any reduction in width, to give constant flow cross-sectional areas along the paths. Furthermore, the ring member 50 may be omitted. The guide members 51 may be flanged to provide an array of flanges between the extensions 28 and the conveyor paths, which array serves as a substantially continuous or interrupted partition.

The air flow generated by the extensions 28, acting collectively as an impeller, can be adjusted by the attenuator means 70, thereby adjusting the flow through the conveyor zone 41, and in turn adjusting the speed of rotation of the flow emanating from the guide means 17. In this manner the centrifugal forces tending to reject oversize particles through the return path A to the final portion 45 may be altered and the threshold of particle size admitted to the outlet 15 adjusted independently of the rotary classifier 18 or even in the absence of a rotary classifier 18.

It is preferable that by-pass forces generated by the air flow through the machine are substantially equal to or somewhat greater than the impeller forces generated by the outer extensions 28 and prevent a net outward air movement through the return path, so as to minimize recycling of very small particles.

To this end, and to provide fine control of the classification, the rotary attenuator may be mounted on a shaft concentric with the rotary classifier shaft for independent rotation.

The classifier or attenuator may be driven by a shaft passing through the rotor shaft.

The apparatus may be supplied with gas, gaseous medium, or a mixture thereof with air instead of an air supply. The air may be supplied under pressure, or the flow may be drawn from the duct 66 to induce the flow into the air inlet.

I claim:

1. A pulverizing machine comprising:

(a) a housing defining a chamber having an air inlet means and an outlet means, (b) means to introduce material into the chamber for pulverizing, (c) a pulverizer rotor member mounted within the chamber to rotate about an axis and including a plurality of pulverizer members peripherally disposed thereon, (d) conveyor means spaced apart from one side of said pulverizer rotor member, (e) said conveyor means including guide means, and (f) classifier means located adjacent said one side of the pulverizer rotor member, (g) said housing and pulverizer rotor member being disposed with respect to each other to define an annular reducing zone in said chamber and around the rotor member, and into which reducing zone the pulverizer members project to cause material to be pulverized in said reducing zone and to impart a rotation to the flow of air and material in said reducing zone, (h) said housing, conveyor means and guide means being disposed with respect to each other to define an annular conveyor zone in said chamber, (i) said conveyor zone having a radially outer portion which is alongside and is open toward said reducing zone to admit a rotating flow of pulverized material and air to pass in a first axial direction into said conveyor means and said conveyor zone, (j) said conveyor zone having an intermediate portion disposed radially inward of and surrounded peripherally by said outer portion of the conveyor zone, (k) the guide means comprising guide members defining a plurality of partial spiral conveyor paths in said intermediate portion to convey said flow of air and pulverized material spirally inward toward said axis, (l) said conveyor zone having a radially inner portion disposed radially inwards of and peripherally surrounded by said intermediate portion to accept said rotating flow of air and pulverized material from said guide means, (m) the classifier means comprises a cylindrical classifier zone disposed around said axis in said chamber and adjacent to and co-axial with the rotor so as to lie between said one side of the rotor member and said inner portion of the conveyor zone, (n) said conveyor means, classifier means and outlet being arranged with respect to each other so that said inner portion of the conveyor zone lies around a cylindrical wall of the outlet, said cylindrical wall being open toward the classifier zone and said inner portion of said conveyor zone being arranged to turn said rotating flow of air and pulverized material to move, while rotating about said axis, in an axial direction opposite to said first axial direction so as to enter the side of the classifier zone remote from said one side of the rotor member, (o) said classifier zone being co-axial with and peripherally surrounded by an outer portion of said reducing zone, (p) at least one of the pulverizer members having an extension section which extends in said first direction across the periphery of the classifier zone toward said conveyor means so that oversize material from said flow of air and pulverized material entering the classifier zone has a path which extends substantially radially outwardly back to said outer portion of said reducing zone, and smaller material from said flow of air and pulverized material has a path which extends substantially radially inwardly to said outlet, both said paths being separate from the flow of said pulverized material to the classifier zone.

2. A pulverizing machine as defined in claim 1 wherein said conveyor means comprises a partition located between said pulverizer members and said conveyor means.

3. A pulverizing machine as defined in claim 2 wherein the guide members are of partial chordal form.

4. A pulverizing machine as defined in claim 1 wherein the classifier means comprises a rotary classifier member.

5. A pulverizing machine as defined in claim 4 wherein the rotary classifier member is connected by variable speed transmission means to means for driving the pulverizer rotor member.

6. A pulverizing machine as defined in claim 4 wherein the rotary classifier member includes rotary attenuator means.

7. A pulverizing machine as defined in claim 4 wherein the rotary classifier member is confined to an inner portion of the classifier zone.

8. A pulverizing machine as defined in claim 1 wherein rotary attenuator means is disposed in said classifier zone.

9. A pulverizing machine as defined in claim 8 wherein the rotary attenuator means is connected by variable speed transmission means to means for driving the pulverizer rotor member.

* * * * *